US007520226B2

(12) United States Patent
Webster et al.

(10) Patent No.: US 7,520,226 B2
(45) Date of Patent: Apr. 21, 2009

(54) MODEL VEHICLE WITH FORCE-ISOLATING DRIVE MECHANISM

(75) Inventors: Richard F. Webster, Carson, CA (US); Steven R. Greening, Grosse Pointe Woods, MI (US)

(73) Assignee: Lionel L.L.C., Chesterfield, MI (US)

( * ) Notice: Subject to any disclaimer, the term of this patent is extended or adjusted under 35 U.S.C. 154(b) by 335 days.

(21) Appl. No.: 11/139,314

(22) Filed: May 27, 2005

(65) Prior Publication Data

US 2006/0052032 A1 Mar. 9, 2006

Related U.S. Application Data

(60) Provisional application No. 60/575,591, filed on May 28, 2004.

(51) Int. Cl.
*B61D 17/00* (2006.01)

(52) U.S. Cl. ..... 105/1.5

(58) Field of Classification Search ..... 105/1.5, 105/157.2, 238.2; 446/463
See application file for complete search history.

(56) References Cited

U.S. PATENT DOCUMENTS 4,511,343 A * 4/1985 Goldfarb et al. ..... 446/463
4,522,606 A * 6/1985 Goldfarb et al. ..... 446/433
4,799,431 A * 1/1989 Edwards et al. ..... 105/1.5
5,427,561 A * 6/1995 Eichhorn et al. ..... 446/463

* cited by examiner

*Primary Examiner*—S. Joseph Morano
*Assistant Examiner*—Robert J McCarry, Jr.
(74) *Attorney, Agent, or Firm*—O'Melveny & Myers LLP

(57) ABSTRACT

A model vehicle, such as a model electric train, includes a force-isolating drive mechanism. The drive mechanism provides a mechanical linkage and speed reduction between an output shaft of a motor for a model locomotive and its drive wheels, via a gear train. The gear train includes a floating mechanism that permits the model locomotive drive wheels vertical freedom of movement, while still remaining mechanically linked to the gear train. The floating mechanism isolates the model locomotive from forces transmitted from the track bed through the drive wheels, thereby providing a more stable and vibration-free model performance.

16 Claims, 3 Drawing Sheets

MODEL VEHICLE WITH FORCE-ISOLATING DRIVE MECHANISM

CROSS-REFERENCE TO RELATED APPLICATION

This application claims priority pursuant to 35 U.S.C. § 119(e) to U.S. Provisional Application No. 60/575,591, filed May 28, 2004, which application is specifically incorporated herein, in its entirety, by reference.

BACKGROUND OF THE INVENTION

1. Field of the Invention

The present invention relates to electric-powered model vehicles, such as model trains, and more particularly, to an adaptive drive mechanism for a model train or other model vehicle.

2. Description of Related Art

Various model trains and vehicles are known in the art, which model an actual or imaginary train or vehicle at a reduced scale. In a typical model layout, a model train having an engine is provided. The model train engine includes an electrical motor that receives power from a voltage that is applied to model railway tracks. A transformer is used to apply the power to the tracks, while contacts (e.g., a roller) on the bottom of the train, or metallic wheels of the train, pick up the applied power for the train motor. In some model train layouts, the transformer controls the amplitude, and in a DC system, the polarity, of the voltage, thereby controlling the speed and direction of the train. In HO systems, the voltage is a DC voltage. In O-gauge systems, the track voltage is an AC voltage transformed by the transformer from a household line voltage provided by a standard wall socket, such 120 or 240 V, to a reduced AC voltage, such as 0-18 volts AC.

Model electric trains therefore include a drive train linking one or more pairs of powered drive wheels to an electric motor housed in a model locomotive. Many model locomotives make use of a direct gear drive, such as a spur gear set or other gear drive. Direct gear drives provide a direct mechanical link between the motor and the drive wheels, and are generally recognized as providing excellent responsiveness and low backlash for speed control and motion reversal. Properly designed gear drives are also reliable, have low maintenance requirements, and long service lives. These characteristics make gear drives prevalent in many model vehicles.

Notwithstanding their advantages, gear drive mechanisms may be subject to certain disadvantages. Conventional gear drives are used with a relatively rigid or stiff mechanical connection between the drive wheels and the motor. Consequently, displacement of the drive wheels from bumps or unevenness of a model track is transmitted to the model locomotive, which may visibly bounce up and down or sway side-to-side in a way that does not resemble a full-scale locomotive. Modern full-scale locomotives employ sophisticated drive trains and suspension systems, as well as being much more massive than reduced-scale model locomotives. Full-scale model locomotives therefore may exhibit a much smoother, stable response to vibration received from travel over the track bed, as compared to many prior-art model vehicles. Achieving a more realistic dynamic response in model vehicles is desirable, but only within certain economic constraints. For example, merely scaling down all the primary mechanical characteristics of actual locomotives, such as mass, moment of inertia, suspension and drive systems, is not economically feasible for model vehicles intended for consumer toy or hobbyist applications.

Accordingly, a need exists for a model train with a drive mechanism that overcomes these and other limitations of the prior art.

SUMMARY OF THE INVENTION

The invention provides a reduced-scale model vehicle with an adaptive drive mechanism for driving drive wheels of a model locomotive of the like. The drive mechanism transmits motive power through a direct gear drive, without sacrificing the ability to absorb bumps and other irregularities in a model track layout. A model locomotive equipped with the drive mechanism therefore reacts to the track bed in a way that more closely resembles, at a reduced scale, the performance of a full-scale locomotive. At the same time, the benefits of a gear drive, such as responsiveness, low backlash, reliability, and low maintenance, are preserved for the enjoyment of the model hobbyist.

In an embodiment of the invention, a gear drive mechanism provides a direct mechanical linkage to a model locomotive engine, while at the same time providing the drive wheels of the locomotive with a floating mechanism. The gear mechanism may be configured for translating speed and torque from the output shaft of the motor to the drive wheels of a model locomotive, in any suitable manner as known in the art. The floating mechanism permits the drive wheels to "float," in the sense that the drive wheels are provided with freedom of movement relative to the drive mechanism, while still remaining in gear. Thus, when the drive wheels encounter a bump or other unevenness in the track, they are free to move independently of the gear train and of the locomotive. Forces from motion over the track are thereby at least partly isolated from the locomotive, which enjoys a more stable, vibration-free ride. This provides a more realistic effect and enjoyment to the model hobbyist.

In an embodiment of the invention, the gear drive and floating mechanism are provided in a "truck" assembly. The truck comprises a plurality of wheels, which in a full-scale locomotive are needed to bear the massive weight of the locomotive. A reduced-scale truck may be configured to resemble various types of full-scale locomotive trucks. For the convenience of the hobbyist, the model truck may comprise a modular unit that can readily be removed for maintenance, repair or for use with a compatible locomotive.

A more complete understanding of the model vehicle with an adaptive drive mechanism will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a model locomotive with a force-isolating drive train, that overcomes the limitations of the prior art. In the detailed description that follows, like element numerals are used to indicate like elements appearing in one or more of the figures.

Figure 1:
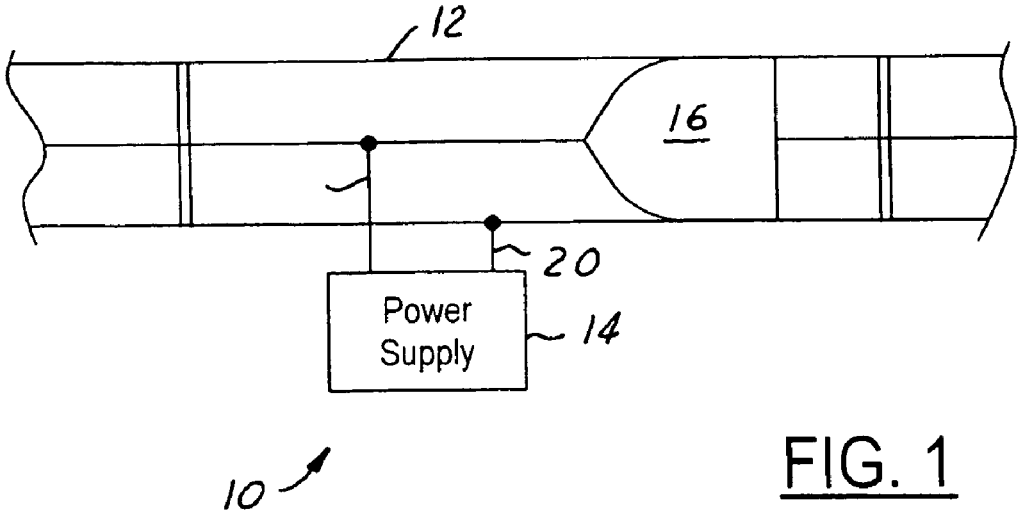
FIG. 1 is a plan view of a model vehicle layout in accordance with the present invention.

FIG. 1 shows a first exemplary embodiment of a model vehicle system 10. Model vehicle system 10 includes a track 12, a power supply 14, and a model vehicle 16. In an exemplary embodiment, track 12 may comprise a three rail track that is configured for travel thereon by model vehicle 16. Power source 14 provides power to track 12 by way of connectors 20 and 22. A power terminal of the power supply may be connected to the center or third rail of track 12 via connector 22, and the neutral terminal may be connected to at least one of the two outer rails of track 12 via connector 20. A locomotive of model vehicle 16 may be configured with contacts on the bottom thereof, or an arrangement of electrically conductive metallic wheels, to pick up the applied power and supply it to an electric motor of the locomotive. In the alternative, or in addition, train cars other than locomotive may be used to pick up the power from track 12. The arrangement described above is for exemplary purposes only and is not meant to be limiting in nature.

Power source 14 may comprise a conventional AC or DC transformer, depending on the requirements of railroad layout 10, and in particular, model vehicle 16. Additionally, power source 14 may provide a fixed output, a variable output, or both. In an exemplary embodiment, railroad layout 10 comprises an O-gauge layout and power source 14 comprises an AC transformer which transforms typical AC line voltage (e.g., 120 VAC) to a reduced level (e.g., 0-18 VAC for a conventional O-gauge variable output model train transformer) and supplies the same to track 12.

Figure 2:
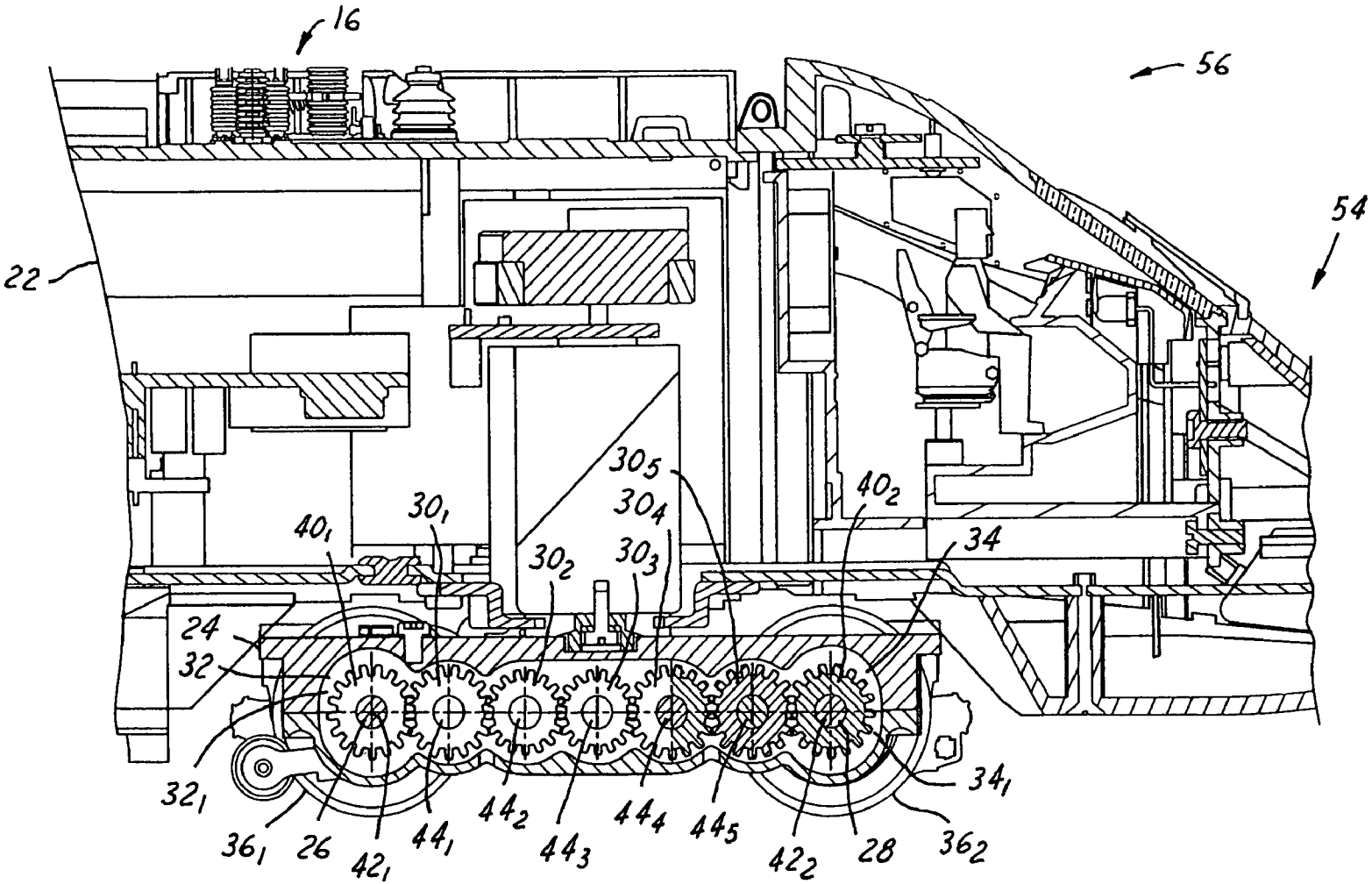
FIG. 2 is a cross-sectional view showing an exemplary embodiment of a gear drive mechanism in accordance with the present invention, assembled to a model locomotive.

With reference to FIG. 2, a portion of model vehicle 16 is illustrated. Model vehicle 16 includes a main body 22, a gear set frame 24 (also called truck 24), a first drive axle 26, a second drive axle 28, a gear set 30, a first interior space 32, and a second interior space 34 in frame 24. Truck 24 may be coupled to main body 22 of model vehicle 16. While only one truck is illustrated and discussed herein, model vehicle 16 may include more than one truck like truck 24 coupled thereto. In an exemplary embodiment, truck 24 is pivotally coupled to main body 22, such as via a ball or pin joint.

Figure 3:
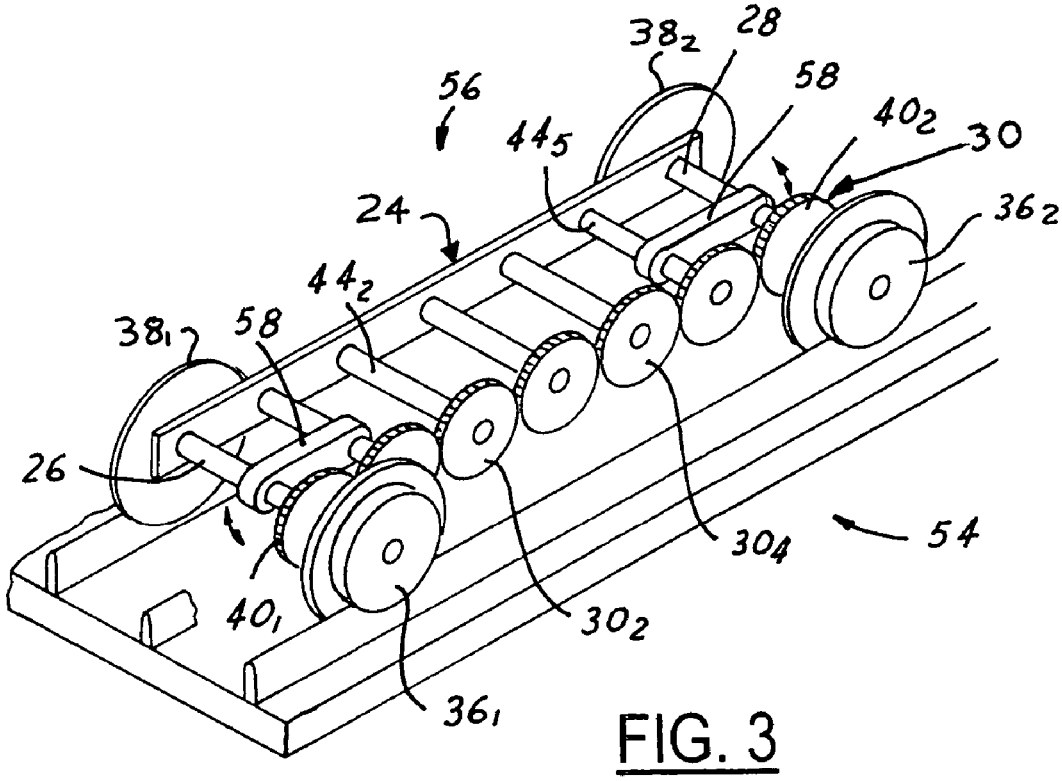
FIG. 3 is a schematic perspective diagram showing a portion of an exemplary drive mechanism in accordance with the present invention.
Figure 4:
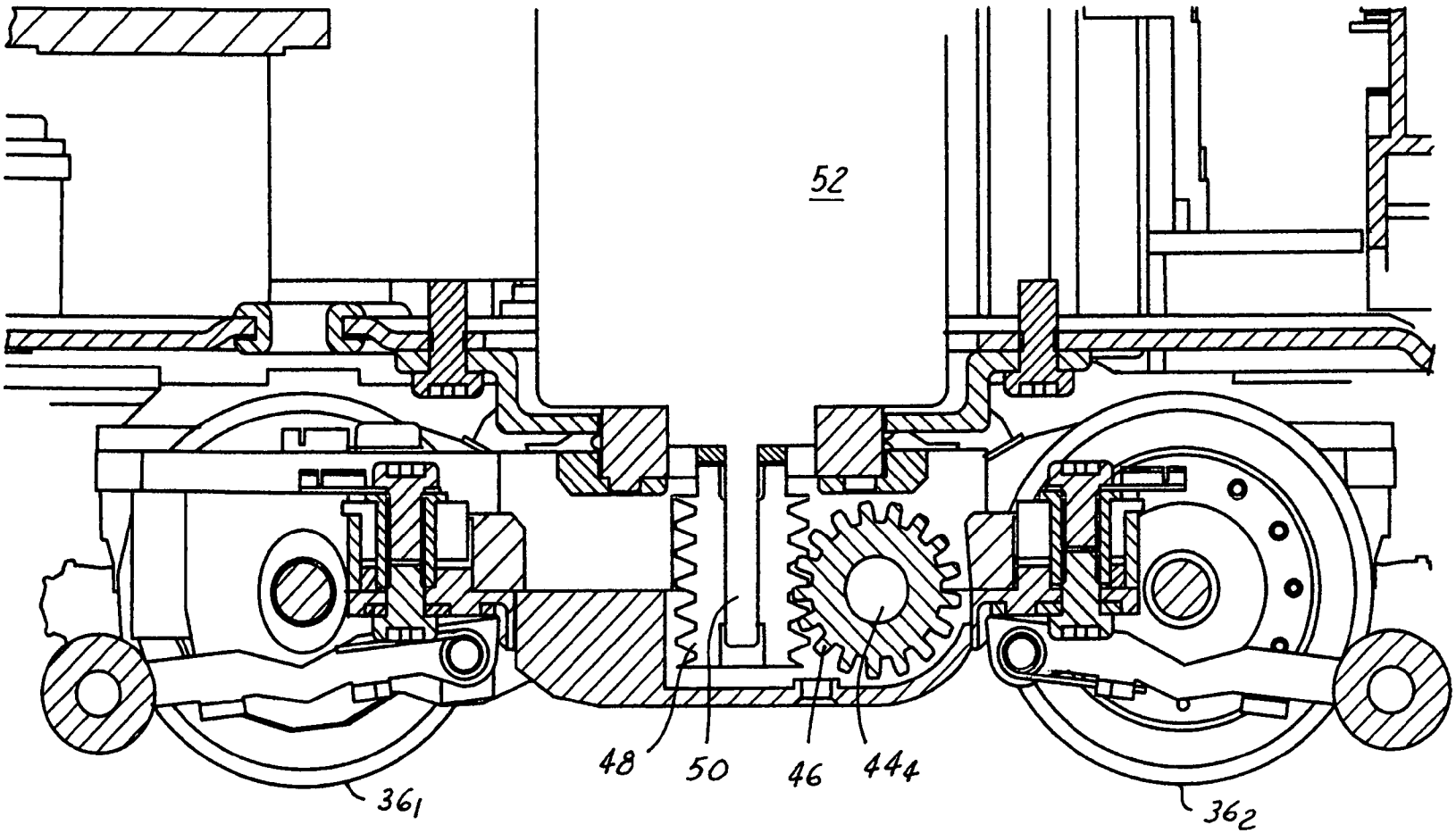
FIG. 4 is a cross-sectional view showing an exemplary embodiment of a gear drive mechanism in accordance with the present invention.

With continued reference to FIGS. 2-4, first and second drive axles 26, 28 may be connected to a respective first and second drive wheels 36, and 362. Respective second wheels $\mathbf{38}_1$, $\mathbf{38}_2$ may likewise be connected to the drive axles on an opposite side of truck 24. Each drive axle may be associated with a respective output gear $\mathbf{40}_1$, $\mathbf{40}_2$ operative to drive each respective drive axle. Each drive axle 26, 28 may be aligned with a respective horizontal longitudinal axis $\mathbf{42}_1$, $\mathbf{42}_2$. In the illustrated embodiment, first and second drive axles 26, 28 are each configured to be mounted to truck frame 24. It should be noted that while the above described arrangement includes a pair of drive axles, this embodiment is provided for exemplary purposes only and is not meant to be limiting in nature. Vehicles having more or less drive axles and associated output gears and wheels remain within the spirit and scope of the present invention.

Gear set 30, also called a gear train, may be mounted to frame 24, disposed between and engaged with first and second drive axles 26, 28. Gear set 30 may comprise one or more gears, such as, for example, five gears $\mathbf{30}_1$, $\mathbf{30}_2$, $\mathbf{30}_3$, $\mathbf{30}_4$, $\mathbf{30}_5$, each of which is in mesh with each adjacent gear of gear set 30, and each of which has its own respective gear axle $\mathbf{44}_1$, $\mathbf{44}_2$, $\mathbf{44}_3$, $\mathbf{44}_4$, $\mathbf{44}_5$, coupled to frame 24. Two gears of gear set 30, gears $\mathbf{30}_1$ and $\mathbf{30}_5$, for example, are also in mesh with output gears $\mathbf{40}_1$, $\mathbf{40}_2$, respectively, and accordingly, gear set 30 is operative to assist in the driving of output gears $\mathbf{40}_1$, $\mathbf{40}_2$, and therefore, model vehicle 16. As shown in FIG. 4, one of gear axles $\mathbf{44}_1$, $\mathbf{44}_2$, $\mathbf{44}_3$, $\mathbf{44}_4$, $\mathbf{44}_5$, such as gear axle $\mathbf{44}_4$ for example, may be coupled to a second gear 46 that is configured and arranged to be in mesh with and driven by an input gear 48. Input gear 48 may comprise a vertically-oriented worm gear, or other suitable gear, coupled to an output shaft 50 of a drive motor 52 that powers and causes model vehicle 16 to move.

When model vehicle 16 is commanded to move, motor 52 turns output shaft 50. Worm gear 48 is attached to shaft 50 and rotates in either a clockwise or counterclockwise direction. This rotation is transferred to gear 46, which then causes axle $\mathbf{44}_4$ and corresponding gear 304 to rotate, which then, through the arrangement of gears in gear set 30, causes output gears $\mathbf{40}_1$, $\mathbf{40}_2$, and therefore, drive axles 26, 28 and wheels $\mathbf{36}_1$, $\mathbf{36}_2$, $\mathbf{38}_1$, $\mathbf{38}_2$ to rotate, thereby causing model vehicle 16 to move. It should be noted, however, that this arrangement and configuration are provided for exemplary purposes only and is not meant to be limiting in nature. In alternate embodiments, gear 46 may be associated with any of gear axles $\mathbf{44}_1$, $\mathbf{44}_2$, $\mathbf{44}_3$, $\mathbf{44}_4$, $\mathbf{44}_5$, or one of the gears of gear set 30 may be driven directly by output shaft 50. Similarly, one of output gears $\mathbf{40}_1$, $\mathbf{40}_2$ may be driven by output shaft 50 with the gears of gear set 30 transferring the rotation of the driven output gear to the other output gear.

An interior space 32 may be provided in or adjacent to frame 24, in which one of the output gears $\mathbf{40}_1$ may be disposed. Referring to FIGS. 2 and 3, space 32 and output gear $\mathbf{40}_1$ may be disposed on a first side 54 of model vehicle 16, proximal to drive wheel $\mathbf{36}_1$. Space 32 should permit a range of vertical movement of output gear $\mathbf{40}_1$. In the illustrated embodiment, space 32 is oblong shaped. Any other suitable shape may also be used. A second space 34 may also be provided in or adjacent to frame 24, in which a second moveable output gear $\mathbf{40}_2$ may be disposed. Space 34 likewise provides a range of vertical motion for output gear $\mathbf{40}_2$.

First drive axle 26 is disposed at least partly within space 32, while second drive axle 28 may be disposed at least partly within space 34. In this arrangement, and with particular reference to FIG. 3, first drive axle 26 and second drive axle 28 may each be pivotally coupled by way of a coupling member 58 to axle 44 of an adjacent gear of gear set 30. Members 58 comprise exemplary moveable links or floating mechanisms by which a portion of axles 26, 28 proximal to output gears $\mathbf{40}_1$, $\mathbf{40}_2$ may be provided with a range of vertical movement. At the same time, a portion of axles 26, 28 distal to output gears $\mathbf{40}_1$, $\mathbf{40}_2$ may be substantially fixed, but with a degree of elasticity that permits vertical movement of the moveable drive wheels $\mathbf{36}_1$, $\mathbf{36}_2$. That is, drive wheels $\mathbf{38}_1$, $\mathbf{38}_2$ may be substantially fixed. In this arrangement, axles 26, 28 or frame 24 act as elastic elements, in essence providing an independent, spring loaded suspension to the drive wheels $\mathbf{36}_1$, $\mathbf{36}_2$ on one side 54 of the locomotive 16. It is believed sufficient, for the purpose of providing improved stability to a model locomotive, to provide the depicted elastic suspension for drive wheels on one side of truck 24. Such a system may be described as a partly independent or quasi-independent suspension. In the alternative, wheels $38_1$, $38_2$ may also be provided with an elastic suspension, permitting vertical movement on a second side 56. Such a fully-independent suspension, however, would likely entail additional complexity and cost, which may make it less desirable for many model vehicle applications.

In the illustrated embodiment, drive axle 26 is pivotally coupled to fixed gear axle $44_1$ of gear $30_1$, while drive axle 28 is pivotally coupled to fixed gear axle $44_5$ of gear $30_5$. It should be noted, however, that illustrated mounting of drive axles 26, 28 to adjacent gear axles, while believed to be advantageous, is provided for exemplary purposes only. Drive axles 26, 28 may be movable coupled to any portion of track frame 24 that is similarly situated to gear axles 44, and that will allow for the functionality described herein. More complex suspensions may be used, but are likely to entail considerably greater cost. For example, a spring-loaded wishbone suspension with universal joints, such as used for automobiles, may be used to permit vertical motion while transmitting torque to the drive wheels. Such an arrangement would likely be much more complex and expensive to implement. On the other hand, various simplified suspensions may be devised that may permit vertical movement of the drive wheels at an acceptable cost, and the invention is not limited to a pivoting coupling as shown in the exemplary embodiment.

In accordance with the illustrated embodiment, when model vehicle 16 traverses an uneven portion of track, axles 26, 28 pivot about adjacent gear axles 44, thereby isolating the locomotive from vertical forces and absorbing energy from the vertical force input. While providing a partly independent suspension, truck 24 and gear train 30 also function as a transmission for transmitting torque to the drive wheels. A cost-effective force-isolating drive mechanism for stabilizing a model vehicle is thus provided, which retains all of the advantages of conventional gear drives.

Having thus described a preferred embodiment of a model vehicle with an force-isolating drive mechanism, it should be apparent to those skilled in the art that certain advantages of the within system have been achieved. It should also be appreciated that various modifications, adaptations, and alternative embodiments thereof may be made within the scope and spirit of the present invention. For example, a particular drive mechanism has been illustrated, but it should be apparent that the inventive concepts described above would be equally applicable to other mechanisms, for example belt drives or chain drives, arranged according to the spirit and scope of the invention. The invention is defined by the following claims.

What is claimed is:

1. A model vehicle, comprising:

a reduced-scale model vehicle;

a motor mounted to the model vehicle, the motor having an output shaft; and a gear train comprising a plurality of enmeshed spur gears, an input gear engaged with the output shaft, a first output gear engaged with a first drive wheel of the model vehicle, and a second output gear engaged with a second drive wheel of the model vehicle, wherein (1) the first output gear is supported by a first movable link, the first movable link permitting free vertical movement of the first output gear relative to a remainder of the gear train, without disengaging the first output gear from the gear train, (2) the second output gear is supported by a second movable link, the second movable link permitting free vertical movement of the second output gear relative to a remainder of the gear train, without disengaging the second output gear from the gear train, and (3) at least some of the plurality of enmeshed spur gears are disposed between and engaged with the first and second drive wheels as to transfer the rotation of the output shaft of the motor to the first and second drive wheels.

2. The model vehicle of claim 1, further comprising a truck frame coupled to the model vehicle, the truck frame housing the plurality of spur gears.

3. The model vehicle of claim 2, further comprising first and second drive axles supported by the truck frame, wherein the first axle is connected to the first output gear and the first drive wheel, and the second drive axle is connected to the second output gear and the second drive wheel.

4. The model vehicle of claim 3, wherein the truck frame comprises an interior space configured to permit vertical motion of the first and second drive axles.

5. The model vehicle of claim 3, wherein the first and second moveable links pivotally couple the first and second drive axles to respective adjacent gear axles of the gear set.

6. The model vehicle of claim 2, wherein the truck frame is pivotally coupled to said main body.

7. The model vehicle of claim 1, wherein the model vehicle comprises a model locomotive, and the first drive wheel is configured for running on a model railroad track.

8. The model vehicle of claim 1, wherein the input gear comprises a worm gear coupled to the output shaft.

9. The model vehicle of claim 8, wherein the worm gear is vertically oriented and drives a driven gear around a horizontal axis.

10. The model vehicle of claim 1, wherein the first output gear is connected to a first axle.

11. The model vehicle of claim 10, wherein the first axle is oriented substantially horizontally and comprises a distal portion mounted to a frame for the gear set, and a proximal portion pivotally supported with respect to the gear set frame by the first moveable link, the proximal portion proximal to the first output gear.

12. model vehicle of claim 11, wherein the first movable link comprises a first operative end connected to the proximal portion of the first axle, and a second operative end supported by an axle of an adjacent gear of the gear train.

13. The model vehicle of claim 11, further comprising a second drive wheel connected to the distal portion of the first axle.

14. The model vehicle of claim 11, wherein the gear train further comprises a second output gear connected to a second axle and to a second drive wheel.

15. The model vehicle of claim 14, wherein the second axle is oriented substantially horizontally and comprises a distal portion mounted to the gear set frame, and a proximal portion pivotally supported with respect to the gear set frame by a second moveable link, the proximal portion of the second axle proximal to the second output gear.

16. The model vehicle of claim 15, wherein the second movable link has a first operative end connected to the proximal portion of the second axle, and a second operative end supported by an axle of an adjacent gear of the gear train.

* * * * *